US007607448B2

(12) United States Patent
Hawks, Jr. et al.

(10) Patent No.: US 7,607,448 B2
(45) Date of Patent: Oct. 27, 2009

(54) METHOD FOR MODIFYING A PLASTIC BODY VALVE FOR USE IN A WASTE WATER SYSTEM

(75) Inventors: William Robert Hawks, Jr., Orlando, FL (US); Shawn D. Bush, Orlando, FL (US)

(73) Assignee: I-CON Systems, Inc., Oviedo, FL (US)

( * ) Notice: Subject to any disclaimer, the term of this patent is extended or adjusted under 35 U.S.C. 154(b) by 115 days.

(21) Appl. No.: 11/246,457

(22) Filed: Oct. 7, 2005

(65) Prior Publication Data

US 2006/0076052 A1 Apr. 13, 2006

Related U.S. Application Data

(60) Provisional application No. 60/617,264, filed on Oct. 8, 2004.

(51) Int. Cl.
*F16K 43/00* (2006.01)

(52) U.S. Cl. ..... 137/15.18; 137/315.04; 137/315.05; 251/366

(58) Field of Classification Search ..... 137/15.18, 137/15.01, 315.01, 315.04, 315.05; 251/366
See application file for complete search history.

(56) References Cited

U.S. PATENT DOCUMENTS

| | | | | | |
|---|---|---|---|---|---|
| 3,987,529 | A | * | 10/1976 | Nakagawa et al. | 29/890.129 |
| 4,053,136 | A | * | 10/1977 | Perl | 251/11 |
| 4,301,992 | A | | 11/1981 | Karbo | |
| 4,336,918 | A | | 6/1982 | Karbo | |
| 4,440,139 | A | * | 4/1984 | Naito et al. | 123/568.3 |
| 4,477,051 | A | | 10/1984 | Ben-Yehuda | |
| 4,672,692 | A | * | 6/1987 | Savage | 4/541.2 |
| 4,787,413 | A | | 11/1988 | Saggers | |
| 4,797,820 | A | | 1/1989 | Wilson et al. | |
| 4,893,645 | A | | 1/1990 | Augustinas et al. | |
| 5,438,714 | A | | 8/1995 | Shaw | |
| 5,575,308 | A | * | 11/1996 | Marandi | 137/356 |
| 5,853,026 | A | | 12/1998 | Wlodarczyk et al. | |
| 6,109,851 | A | * | 8/2000 | Bauer et al. | 411/411 |
| 6,164,888 | A | * | 12/2000 | Kocks | 411/428 |
| 6,557,580 | B2 | | 5/2003 | Lohde et al. | |
| 7,121,556 | B2 | * | 10/2006 | Barth et al. | 277/596 |

* cited by examiner

*Primary Examiner*—Kevin L Lee
(74) *Attorney, Agent, or Firm*—The Webb Law Firm

(57) ABSTRACT

A method is provided for retrofitting a conventional plastic valve to allow the valve to be utilized in a waste water system. The method includes strengthening the valve or valve housing using various methods.

11 Claims, 7 Drawing Sheets

METHOD FOR MODIFYING A PLASTIC BODY VALVE FOR USE IN A WASTE WATER SYSTEM

CROSS REFERENCE TO RELATED APPLICATIONS

This application claims the benefits of U.S. Provisional Application Ser. No. 60/617,264, filed Oct. 8, 2004, and herein incorporated by reference in its entirety.

This application is related to U.S. application Ser. No. 11/246,456 entitled "Diaphragm Valve With Mechanical Pressure Relief", filed concurrently herewith, and herein incorporated by reference in its entirety.

BACKGROUND OF THE INVENTION

1. Field of the Invention

This invention relates generally to diaphragm valves and, in one particular embodiment, to a method of modifying a conventional plastic body irrigation valve for use as a flush valve in a waste water system.

2. Technical Considerations

In most waste water systems, such as the flushing systems for urinals commodes, and the like, the valves associated with these systems are traditionally metal valves. Metal valves provide strength for withstanding fluctuations that may occur in the water pressure of the flushing system and also maintain their ability to function over prolonged and consistent use. However, these traditional metal flush valves do have some drawbacks. For example, these metal valves are typically relatively heavy and cumbersome to install and repair. Moreover, with continued use, metal valves may corrode or rust, and/or develop mineral deposits, which can require replacement of the entire valve. Additionally, such metal valves are typically expensive to manufacture and maintain.

Plastic valves are generally lighter in weight and less costly than metal valves and eliminate the corrosion possibility associated with metal valves while reducing the development of mineral deposits. However, plastic valves are typically not as strong as metal valves. And, it could be expensive to design and manufacture a new plastic bodied valve for use in these conventional waste water systems. It would be more cost effective if one could utilize an existing plastic bodied valve to replace the metal valves in these conventional waste water systems. While plastic valves do exist, these known plastic valves are not capable of meeting the American Society Of Sanitary Engineering (ASSE) requirements for use in conventional waste water systems. For example, one ASSE requirement is that the valves in the waste water system must not leak at a fluid pressure of 500 psi or, if the valve incorporates a relief valve, the valve must hold two-times the relief pressure without leaking. Most conventional plastic bodied valves cannot meet these limitations.

Therefore, it would be desirable to provide a method of retrofitting an existing plastic bodied valve to meet the ASSE requirements so that the valve could be utilized in a waste water system. The use of an existing commercial plastic valve would help decrease the initial costs of the installation and the plastic valve would provide advantages, such as light weight and reduced corrosion susceptibility, over the known metal valves.

SUMMARY OF THE INVENTION

A method of retrofitting a conventional plastic valve having brass pressed insert nuts and stainless steel or aluminum bolts to allow the valve to be utilized in a waste water system comprises replacing the stainless steel or aluminum bolts of the valve with higher tensile steel bolts, and replacing the brass pressed insert nuts of the valve with steel insert nuts.

BRIEF DESCRIPTION OF THE DRAWINGS

Additional advantages and details of the invention are explained in greater detail below with reference to the exemplary embodiments that are illustrated in the accompanying schematic figures, in which.

DESCRIPTION OF THE PREFERRED EMBODIMENTS

Figure 1:
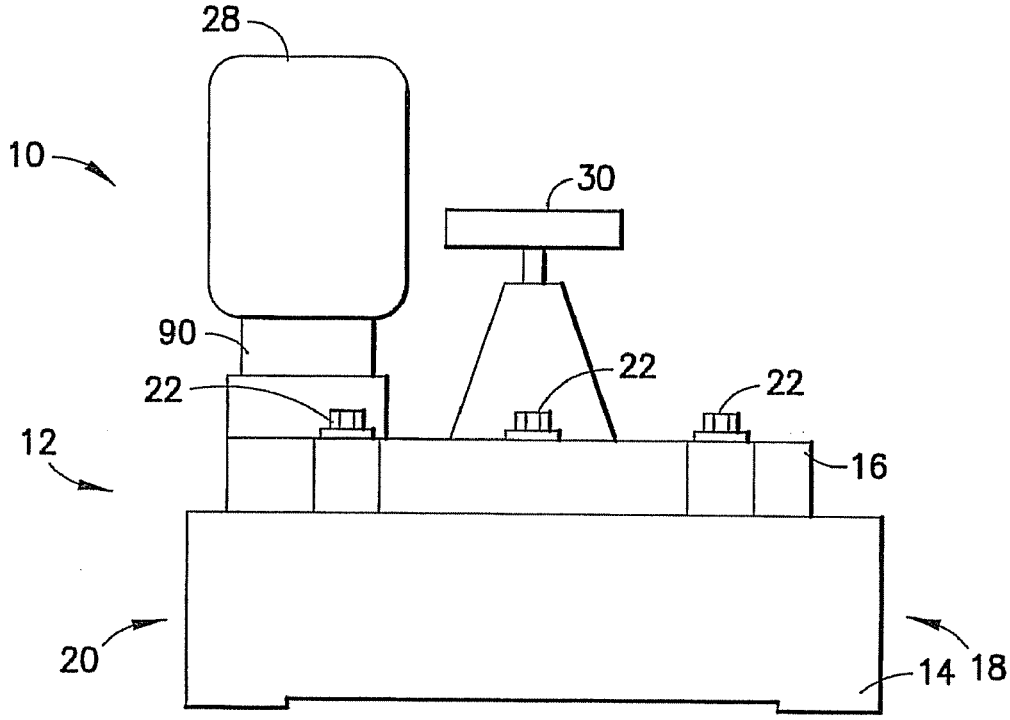
FIG. 1 is a side view of a conventional plastic bodied valve.

As used herein, spatial or directional terms, such as "up", "down", "above", "below", "top", "bottom", and the like, relate to the invention as it is shown in the drawing figures. However, it is to be understood that the invention can assume various alternative orientations and, accordingly, such terms are not to be considered as limiting. Further, all numbers expressing dimensions, physical characteristics, processing parameters, quantities of ingredients, reaction conditions, and the like, used in the specification and claims are to be understood as being modified in all instances by the term "about". Accordingly, unless indicated to the contrary, the numerical values set forth in the following specification and claims are approximations that can vary depending upon the desired properties sought to be obtained by the present invention. At the very least, and not as an attempt to limit the application of the doctrine of equivalents to the scope of the claims, each numerical value should at least be construed in light of the number of reported significant digits and by applying ordinary rounding techniques. Moreover, all ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more and ending with a maximum value of 10 or less, e.g., 1 to 6.1, 3.5 to 7.8, 5.5 to 10, etc. All references referred to herein, such as but not limited to issued patents and published applications, are to be understood to be incorporated by reference in their entirety.

Figure 2:
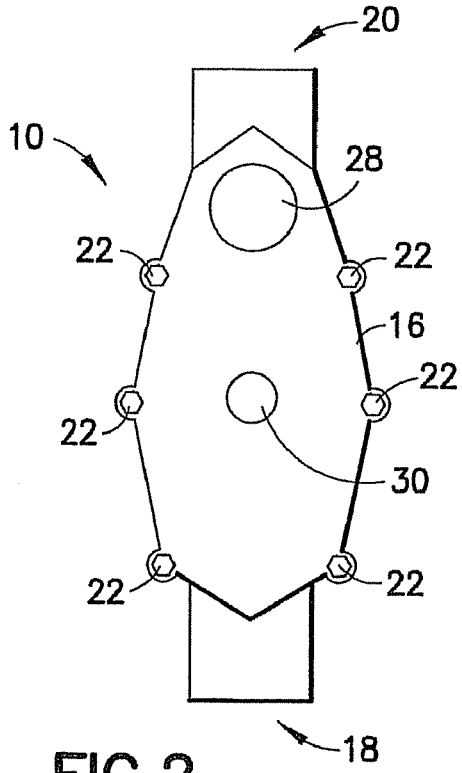
FIG. 2 is a top view of the valve of FIG. 1.

FIGS. 1 and 2 show an existing plastic bodied irrigation valve 10 which can be used as a starting point for the practice of the present invention. The specific structure and operation of this conventional valve 10 is disclosed in U.S. Pat. No. 4,336,918 and, therefore, will not be described in detail. However, various selected elements of the valve 10 will be described in order to clarify the subsequent discussion of the invention.

This known irrigation valve 10 is a diaphragm-type valve having a plastic valve housing 12 formed by a plastic valve body 14 and a cover 16. The valve body 14 has a flow passage extending therethrough with an inlet end 18 and an outlet end 20. The cover 16 is connected to the valve body 14 by a plurality of bolts 22, such as aluminum or low-grade stainless steel bolts, threadably engagable with brass pressed insert nuts 24 in the valve body 14. A diaphragm 26 of rubber or plastic is sandwiched between the valve body 14 and the cover 16 to form a seal between the two chambers of the valve 10. A valve element (not shown) is positioned in the flow passage and engages the central region of the diaphragm 26. The valve 10 further includes a solenoid valve 28 threadably attached to the cover 16 and operationally connected with a vent system to control water pressure in a control chamber, as described in detail in U.S. Pat. No. 4,336,918. This vent system includes a crescent-shaped passage in flow communication on one end with the control chamber and on the other end with a vent outlet. The flow through the vent outlet is controlled by a plunger associated with the solenoid valve 28, which can be moved to open or close the vent outlet. This conventional valve 10 also includes a rotatable stop 30 that can be used to adjust or control the maximum opening position of the valve element.

Without modification, this valve 10 does not meet the ASSE requirements and would not be acceptable for use in a waste water system. However, in the practice of the invention, this existing valve 10 can be modified such that the modified valve assembly can meet or exceed the ASSE requirements for waste water-systems and, therefore, can be used to replace the conventional metal valves used in existing waste water systems.

Figure 3:
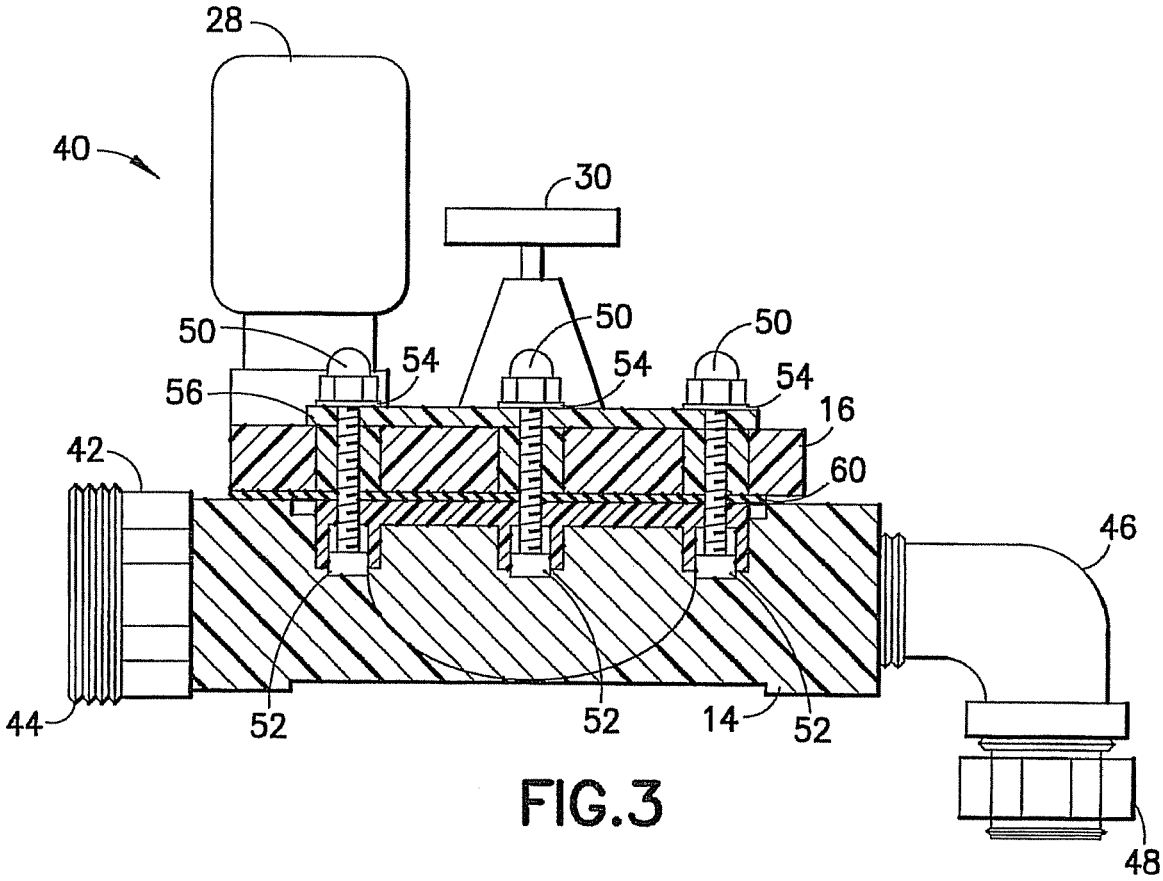
FIG. 3 is a side view of a first embodiment of a valve incorporating various features of the invention.
Figure 4:
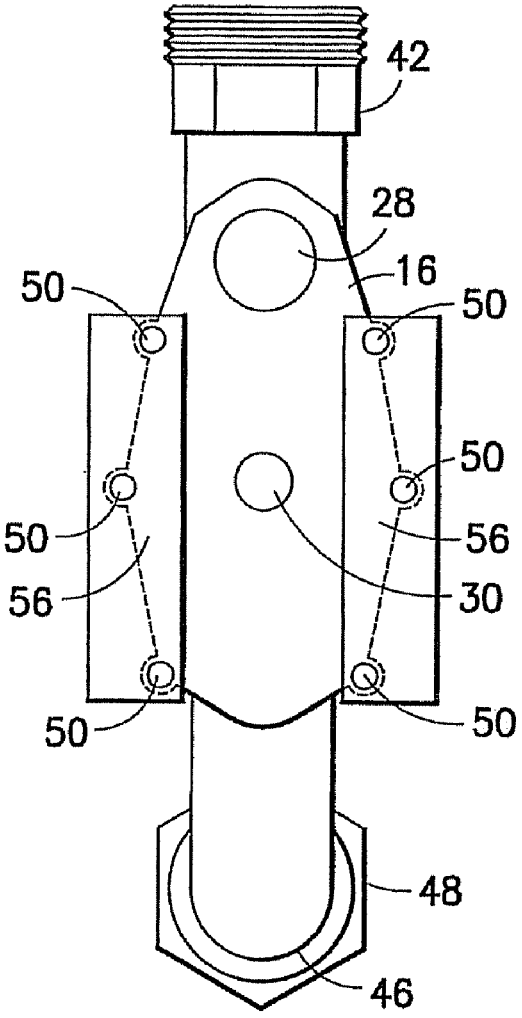
FIG. 4 is a top view of the valve of FIG. 3.

FIGS. 3 and 4 show a first modified valve assembly 40 utilizing the existing irrigation valve 10 but modifying the valve 10 in accordance with the invention to conform with ASSE requirements for use in a waste water system. The valve assembly 40 includes an outlet adapter 42 attached to the outlet end 20 of the valve body 14. The outlet adapter 42 is configured to engage a vacuum breaker in a conventional waste water system. In one embodiment, the outlet adapter 42 can be a 1 inch by 1.5 inch (2.5 cm by 3.75 cm) plastic or metal adapter. The outlet adapter 42 can engage the outlet end 20 of the valve body 14 in any conventional manner, such as by threads, and can have an external threaded region 44 configured to engage a conventional vacuum breaker.

The valve assembly 40 can also include a conventional street elbow 46 connected to the inlet end 18 of the valve body 14. For example, the elbow 46 can be a conventional 1 inch (2.5 cm) diameter metal or plastic elbow. A conventional inlet tail piece assembly 48 having a nut, an O-ring, and slip ring can be attached to the street elbow 46. The inlet assembly 48 allows the valve assembly 40 to be attached to a standard flush valve control stop in an existing waste water system.

Figure 5:
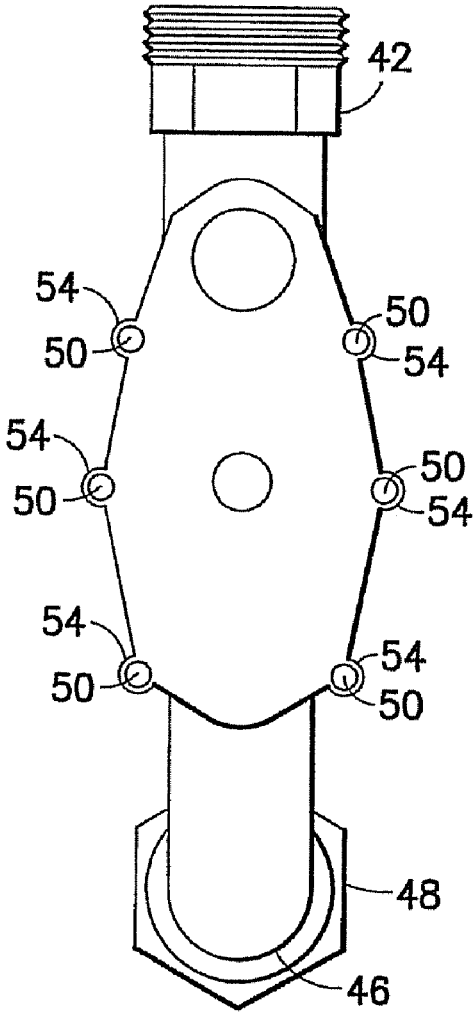
FIG. 5 is a top view of an alternative embodiment of the valve of FIG. 3.

In order for the valve assembly 40 to meet the ASSE requirements for use in a waste water system, one or more further modifications can be made to the existing valve 10. For example, the low-grade stainless steel or aluminum bolts 22 utilized with the conventional valve 10 can be replaced by higher tensile bolts 50, such as steel bolts. Additionally, the brass pressed insert nuts 24 can be replaced with steel insert nuts 52. As shown particularly in FIG. 5, a steel washer 54 can be added at one or more of the bolt locations to strengthen the valve assembly 40.

As shown particularly in FIGS. 3 and 4, in addition to or in lieu of the steel washers 54, reinforcement plates 56 can be connected at or between two or more of the bolt locations. These plates 56 can help distribute the force of the bolts 50 across more of the surface area of the cover 16 to help strengthen the connection between the valve body 14 and the cover 16 and prevent leaks at high pressure, e.g., pressures above 200 psi, such as above 300 psi, such as above 400 psi, such as above 500 psi. The reinforcement plates 56 can be elongated metal or plastic strips that can have bores through which the bolts 50 can pass. The plates 56 can be positioned lengthwise on the valve cover 16 (as shown in FIG. 4) or can be positioned in a crosswise direction, if desired.

In the original valve 10, the original diaphragm 26 does not cover the entire mating surfaces of the valve body 14 to the cover 16. The original diaphragm 26 creates a seal of about 1/16 inch (0.16 cm) at the interface between the two chambers defined in the valve body 14 and the cover 16. Thus, the cover 16 and valve body 14 actually mate plastic to plastic. However, in the practice of the invention, a gasket 60 of a suitable material, such as but not limited to synthetic, rubber, or plastic, can be added between the valve body 14 and the cover 16 to overlap the edges of the existing diaphragm 26 to create a seal across all or substantially all of the mating surfaces between the valve body 14 and the cover 16. Alternatively, the diaphragm 26 itself can be replaced with another diaphragm, e.g., rubber, synthetic, or plastic diaphragm, having a larger surface area to contact all or substantially all of the mating surface of the valve body 14 and the cover 16 to create a better seal than that in the conventional valve 10.

Figure 6:
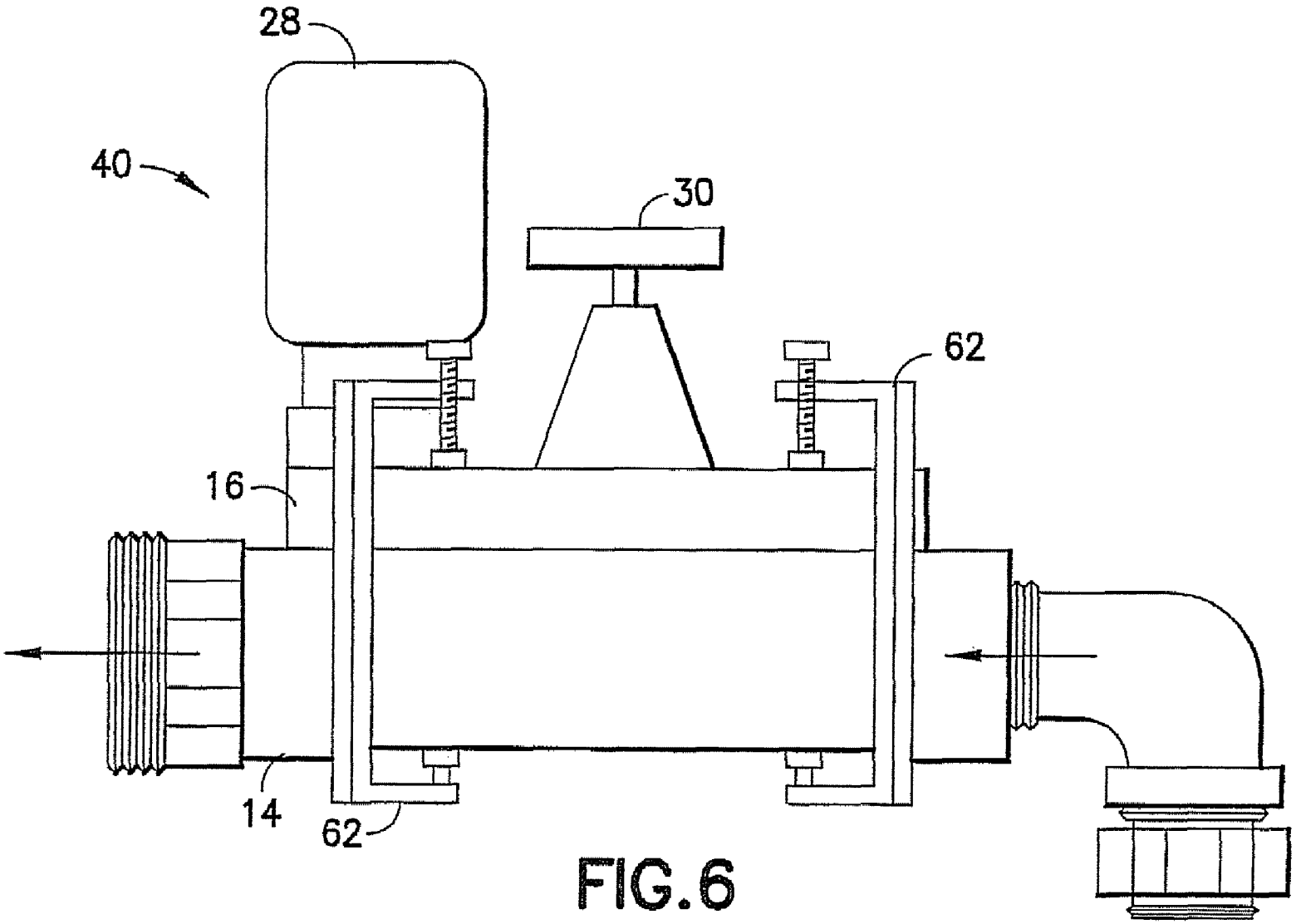
FIG. 6 is a side view of another valve incorporating features of the invention.

FIG. 6 shows another method of strengthening the existing valve housing to meet the ASSE requirements. In this embodiment, one or more brackets 62, such as conventional C-shaped threaded retaining brackets, can be positioned at one or more locations around the valve housing 12. As will be appreciated by one skilled in the art, such brackets 62 would provide additional strength and support to the valve housing 12 to help resist leaks at high water pressures, such as at 500 psi or more. These brackets 62 can be, for example, plastic or metal brackets, and can be removable from the valve housing 12.

Figure 7:
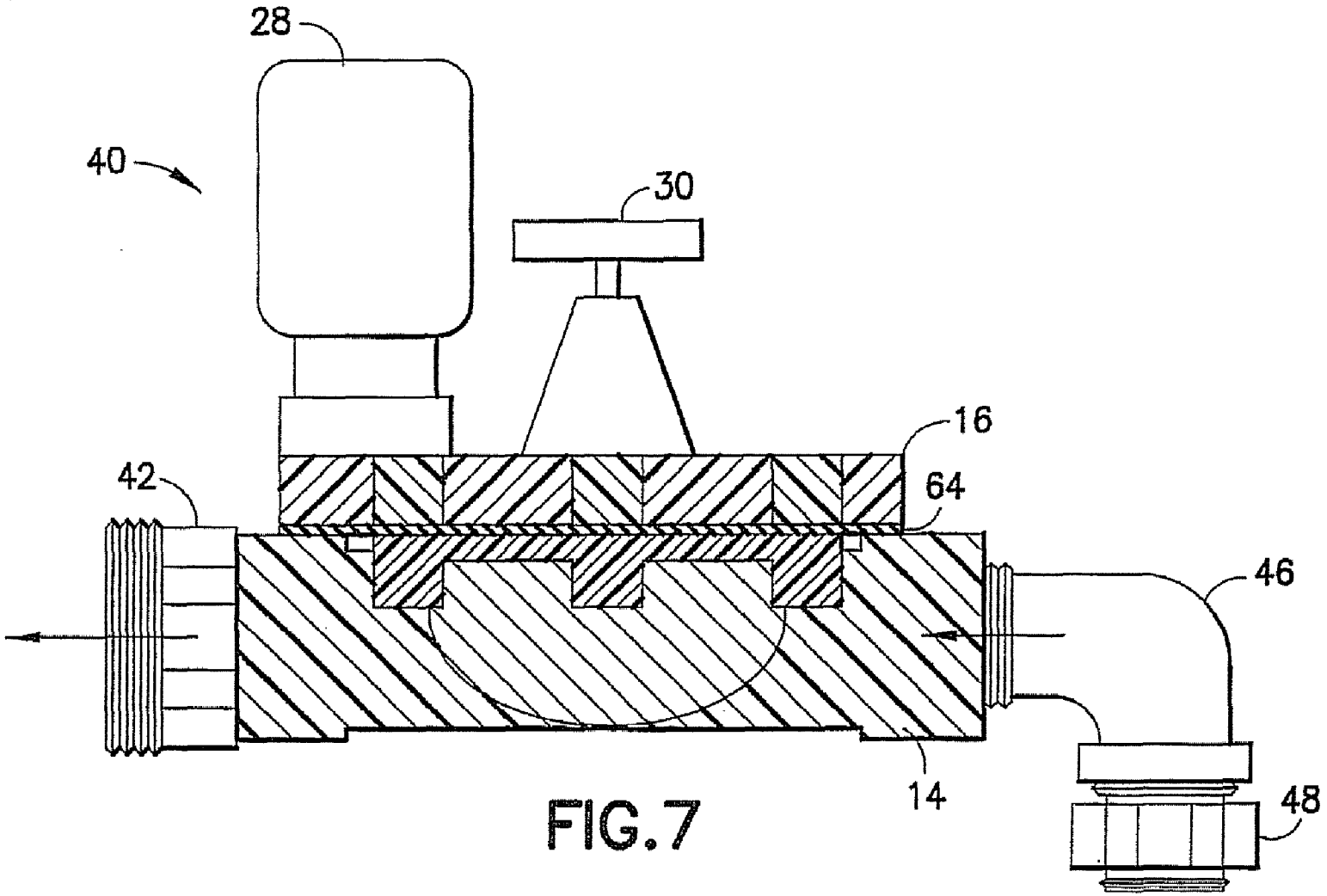
FIG. 7 is a side view of a further valve incorporating features of the invention.

FIG. 7 shows another method of modifying the existing valve 10 for use in a waste water system. In this embodiment, the cover 16 can be disconnected from the valve body 14 and a layer of a conventional permanent adhesive 64 can be applied to the mating surfaces of the cover 16 and/or valve body 14 and then the components reconnected, such as by the original bolts 22 or higher tensile steel bolts 50.

Figure 8:
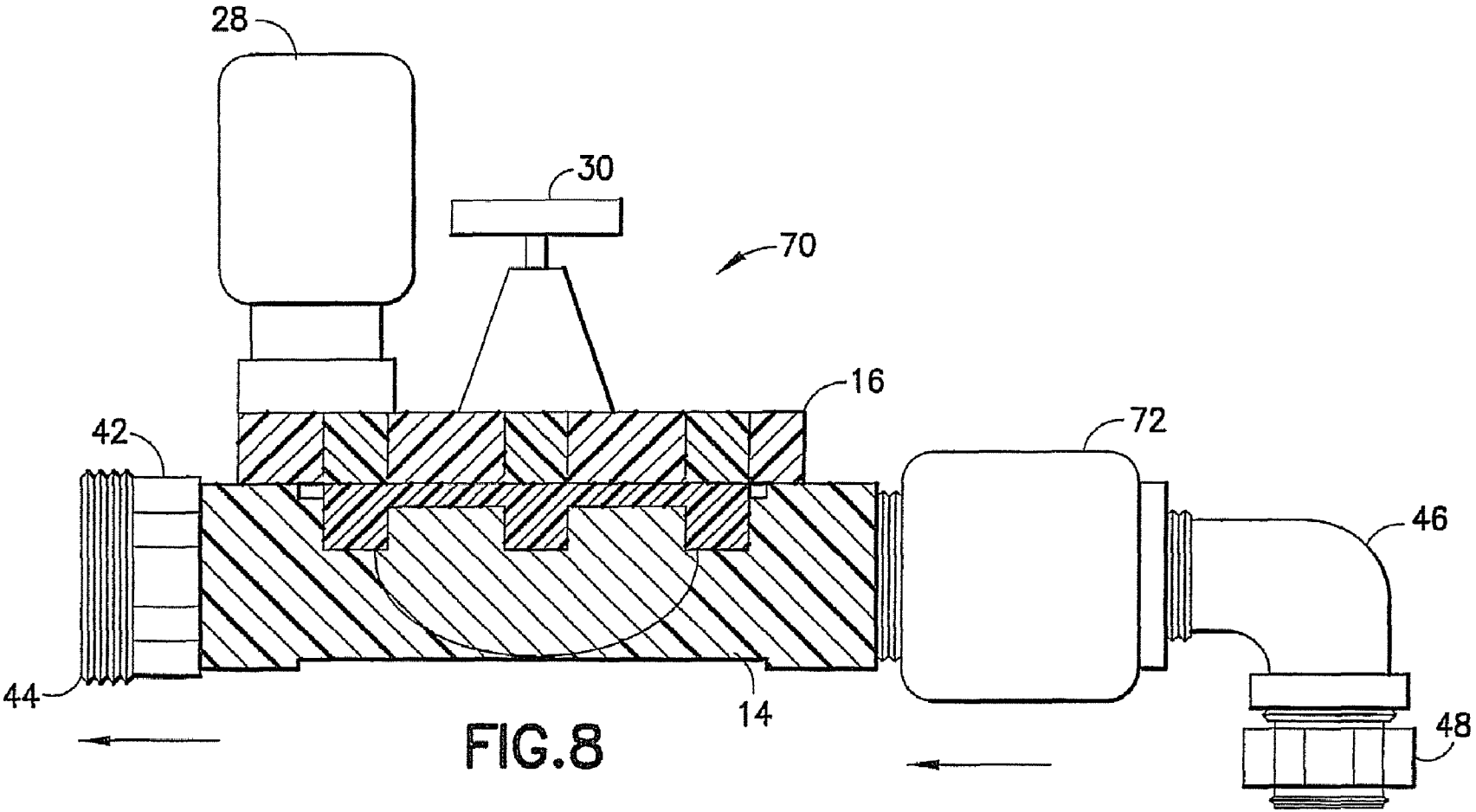
FIG. 8 is a side view of a still further valve assembly of the invention.

FIG. 8 shows an additional modified valve assembly 70 for use in a waste water system. In this embodiment, a conventional pressure regulator 72 can be positioned in the water flow path upstream of the valve 10 to reduce the pressure of the water before the water flows through the valve 10. For example, the pressure regulator 72 can reduce the water pressure from a value of 500 psi or more on the inlet side of the pressure regulator 72 to a pressure of less than 500 psi, such as less than 400 psi, such as less than 300 psi, such as in the range of 50 psi to 200 psi, on the outlet side of the pressure regulator 72. With this embodiment, the known valve 10 can be utilized since the water pressure should not be sufficient to cause leaks. However, one or more of the modifications described above can also be utilized to further strengthen the valve assembly 70.

Figure 9:
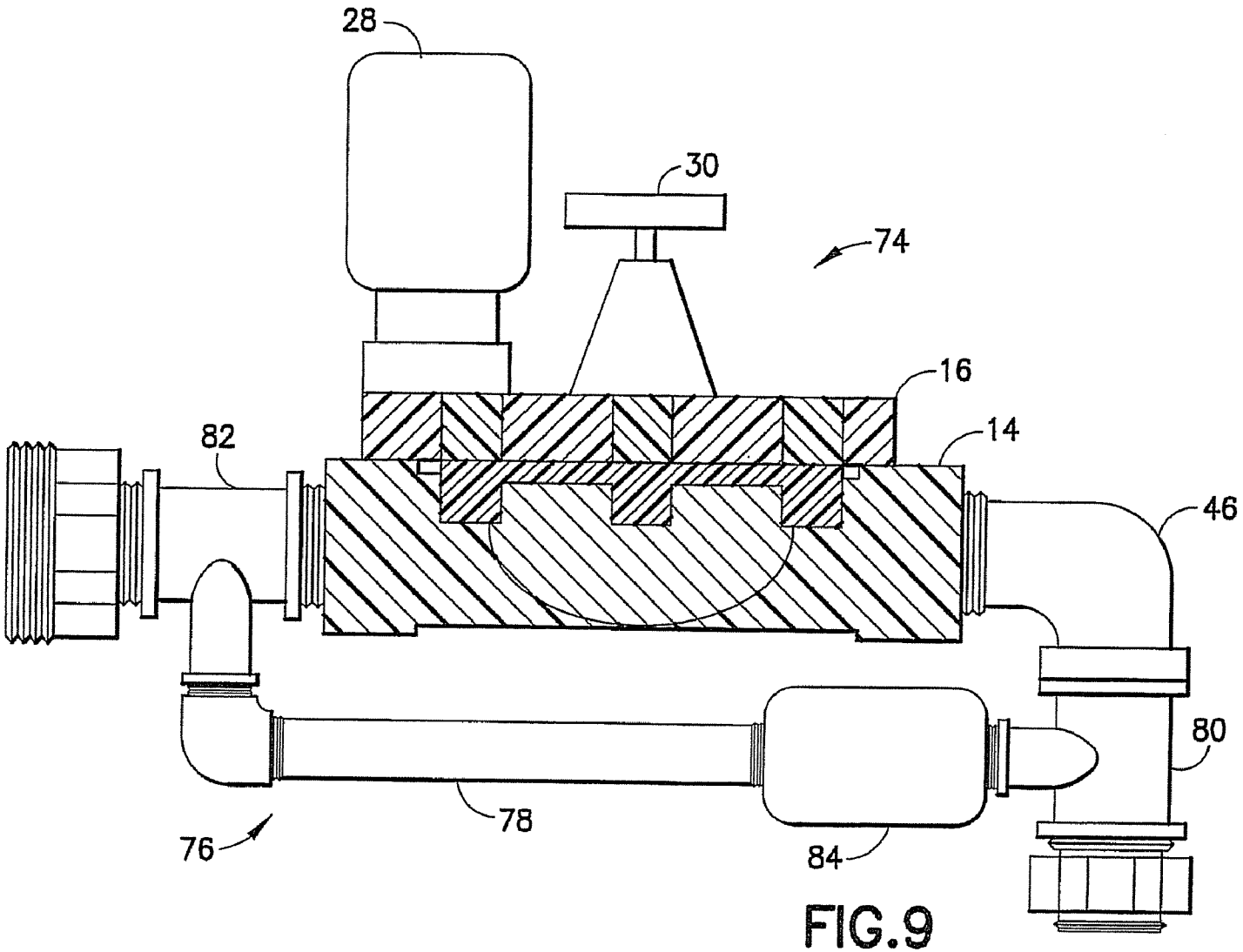
FIG. 9 is a side view of another valve assembly incorporating features of the invention.

FIG. 9 shows another modified valve assembly 74 in accordance with the invention. In this embodiment, a separate bypass assembly 76 is provided. The bypass assembly 76 includes a bypass conduit 78 extending from inlet piping 80 of the valve assembly 74 to outlet piping 82 of the valve assembly 74, with a conventional pressure relief valve 84 located in the bypass conduit 78. The pressure relief valve 84 can be configured such that at a fluid pressure above a preset value, the pressure relief valve 84 opens to direct water flow around the valve 10 and, hence, decrease the inlet pressure on the valve housing 12 to a predetermined amount.

Various methods and structures have been described above for modifying an existing irrigation valve for use in a waste water system. While the modifications above were presented in the form of different embodiments, it will be appreciated by one of ordinary skill in the art that the above embodiments are not mutually exclusive. For example, one or more of the above described modifications in one embodiment can be utilized with or instead of the modifications described in another embodiment.

What is claimed is:

1. A method of retrofitting a conventional plastic valve having brass pressed insert nuts and stainless steel or aluminum bolts to allow the valve to be utilized to meet pressure requirements of at least 500 psi for use as a flush valve in a waste water system, the method comprising:

replacing the stainless steel or aluminum bolts of the valve with higher tensile steel bolts; and/or replacing the brass pressed insert nuts of the valve with steel insert nuts.

2. The method as claimed in claim 1, including providing a steel washer at one or more screw locations on the valve.

3. The method as claimed in claim 1, including providing at least one metal or plastic support plate to connect two or more screw locations.

4. The method as claimed in claim 1, wherein the valve comprises a valve body and cover and the method includes providing one or more clamps on the valve body and cover to distribute load along a perimeter surface of the valve body.

5. The method as claimed in claim 1, including providing a permanent adhesive between a valve body and cover of the valve.

6. The method as claimed in claim 1, wherein the valve comprises a valve body and a cover and the method includes providing a gasket between the valve body and the cover.

7. The method as claimed in claim 1, wherein the valve comprises a valve body, a cover and a valve diaphragm, the method including replacing the diaphragm with a larger diaphragm to cover more of a sealing surface between the valve body and the cover.

8. The method as claimed in claim 1, including placing a pressure regulator in flow communication with an inlet side of the valve, the pressure regulator configured to decrease an inlet fluid pressure from a supplied value to a pre-selected discharge value.

9. The method as claimed in claim 1, including connecting a bypass assembly between an inlet side and an outlet side of the valve, the bypass assembly including a bypass conduit having a pressure relief valve, with the pressure relief valve configured to lift when a fluid inlet pressure is above a predetermined value.

10. A waste water system incorporating a valve retrofitted as claimed in claim 1.

11. A valve retrofitted as claimed in claim 1.

* * * * *

UNITED STATES PATENT AND TRADEMARK OFFICE

CERTIFICATE OF CORRECTION

PATENT NO. : 7,607,448 B2
APPLICATION NO. : 11/246457
DATED : October 27, 2009
INVENTOR(S) : Hawks, Jr. et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 150 days.

Signed and Sealed this

Twelfth Day of October, 2010

David J. Kappos

David J. Kappos
*Director of the United States Patent and Trademark Office*